United States Patent [19]

Lee

[11] 4,444,322

[45] Apr. 24, 1984

[54] DISPLAY RACK

[75] Inventor: Vernon E. Lee, Dallas, Tex.

[73] Assignee: Frito-Lay, Inc., Dallas, Tex.

[21] Appl. No.: 309,770

[22] Filed: Oct. 8, 1981

[51] Int. Cl.[3] ..... A47F 5/10

[52] U.S. Cl. ..... 211/190; 108/111; 211/187; 211/175

[58] Field of Search ..... 211/190, 189, 191, 182, 211/125; 108/111

[56] References Cited

U.S. PATENT DOCUMENTS

| | | | |
|---|---|---|---|
| 2,276,211 | 3/1942 | Lane . | |
| 2,710,241 | 6/1955 | Lieberman | 312/257 |
| 2,842,268 | 7/1958 | Gumplo | 211/175 X |
| 3,021,961 | 2/1962 | Ruhnke . | |
| 3,272,345 | 9/1966 | Wallace | 211/44 |
| 3,387,855 | 6/1968 | Oliver | 280/79.3 |
| 3,391,797 | 7/1968 | Baldwin | 211/190 |
| 3,519,140 | 7/1970 | Wellman, Jr. . | |
| 3,537,596 | 11/1970 | Brunette . | |
| 3,941,251 | 3/1976 | Izen . | |
| 4,018,340 | 4/1977 | Gold | 211/187 X |
| 4,046,083 | 9/1977 | Murdock et al. | 211/190 X |
| 4,093,078 | 6/1978 | Radek | 211/189 |
| 4,111,309 | 9/1978 | Henry | 211/104 |
| 4,299,327 | 11/1981 | Thauer | 211/186 |

*Primary Examiner*—J. Franklin Foss
*Assistant Examiner*—Robert W. Gibson, Jr.
*Attorney, Agent, or Firm*—Bernard, Rothwell & Brown

[57] ABSTRACT

An adjustable display rack for retail food merchandising which is assembled upon a novel adjustable frame structure. The display rack comprises a pair of end structure assemblies and a pair of center structure assemblies, each of which includes a vertical support member attached to upper and lower horizontally extendible members. Said center structure assemblies are placed between and perpendicular to the end structure assemblies which are positioned parallel to each other. Each center structure assembly is securably attachable to its adjacent end structure assemblies. Means are provided for mounting horizontally planar shelves to each structure assembly.

6 Claims, 5 Drawing Figures

DISPLAY RACK

BACKGROUND OF THE INVENTION

The present invention relates generally to display equipment and more particularly to an adjustable display rack used for retail food merchandising.

It has often been found that retail merchandising display rack systems lack sufficient flexibility for utilization in different shopping environments. For example, individual store space requirements and aisle configurations often differ considerably. Retail display racks are usually designed with certain store layouts in mind and can be adapted to the floor plan of a different store only with considerable expense and time. Consequently, a store which alters its floor plan to enhance customer convenience may require costly alterations or replacement of its existing display racks. Furthermore, the storage and freight expenses associated with retail merchandising displays have resulted in attempts to design merchandising displays which are more space- and weight-efficient as well as easier to handle during storage and shipping.

It has also been found that there is a need for a merchandise display rack which is designed to be rapidly assembled by relatively unskilled personnel, preferably a single individual using no tools, or using, at most, nothing other than a screwdriver.

It has also been found that a need exists for a merchandising display rack which is comprised of interchangeable parts to reduce costs as well as to increase flexibility, for example, a display rack frame capable of accepting shelving of various depths or lengths.

The primary object of this invention is to provide a display rack which is assembled upon a novel adjustable frame structure.

Another object of this invention is to provide a display rack in which the basic frame structure includes adjustable frame members.

A further object of this invention is to provide a display rack in which the frame structure contains adjustable telescopic frame members.

Another object of this invention is to provide a display rack which is universally adjustable so as to conform to various space and display requirements.

A further object of this invention is to provide a display rack that is designed and constructed in such a way as to be stored efficiently during transport or storage so as to decrease storage and shipping costs.

Another object of this invention is to provide a display rack which can be shipped in a knocked-down condition and then quickly assembled at its point of intended use by a relatively unskilled individual using either no tools or nothing other than a screwdriver.

Other objects and advantages of the present invention will become apparent as the description of the invention proceeds.

SUMMARY OF THE INVENTION

The present invention provides an adjustable frame structure containing a pair of end structure assemblies and a pair of center structure assemblies, each of which end and center assemblies includes a centrally-positioned, generally vertical support member, and two generally vertical end support members attached to upper and lower generally horizontal extendible members. The vertical support members may also be extendible. The center assemblies are perpendicularly oriented between the end pair of assemblies, and the assemblies are placed generally parallel to one another. The center structure assemblies are securably attachable at their ends to the end structure assemblies, preferably to the horizontal members of the latter. Means are provided for mounting shelves to each structure assembly. The extendible support members permit the width and depth of the display rack to be adjusted according to the requirements of its location. The extendible members may comprise two or more telescoping members.

Additionally, provision may be made for vertical extension of the display rack by providing vertical support members which are lockably extendible.

It is also preferable that each structure assembly contains one or more ornamental or support members such as panels within the perimeters formed by the vertical and horizontal support members of each structure assembly.

Other objects, features and advantages of the invention will become apparent as the description thereof proceeds when considered in connection with the accompanying illustrative drawings.

DESCRIPTION OF THE PREFERRED EMBODIMENT

Figure 1:
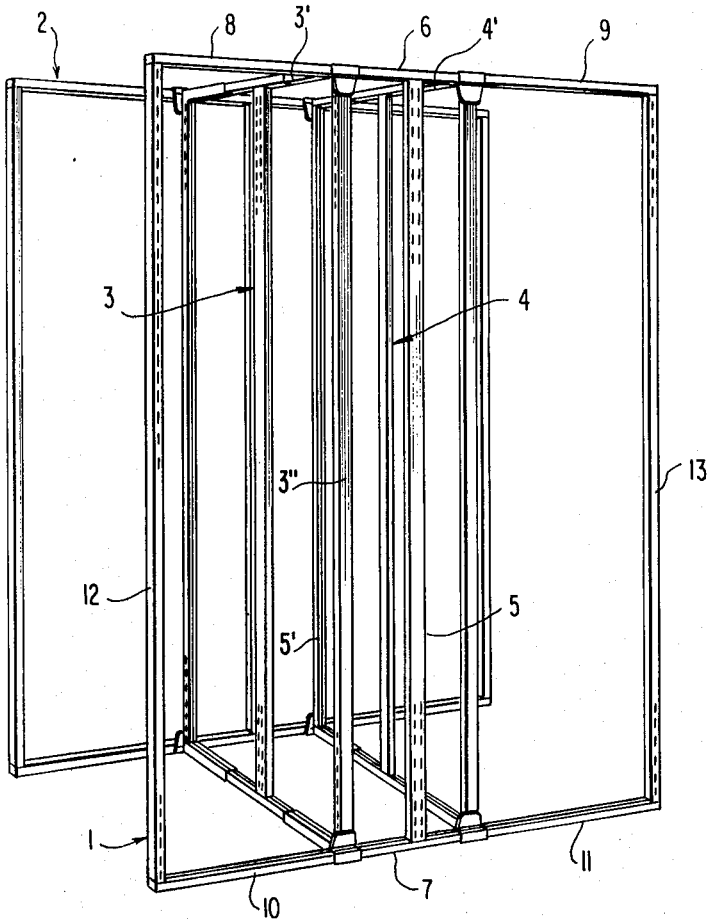
FIG. 1 is a perspective view of the preferred form of the display rack less its shelving and panels.
Figure 2:
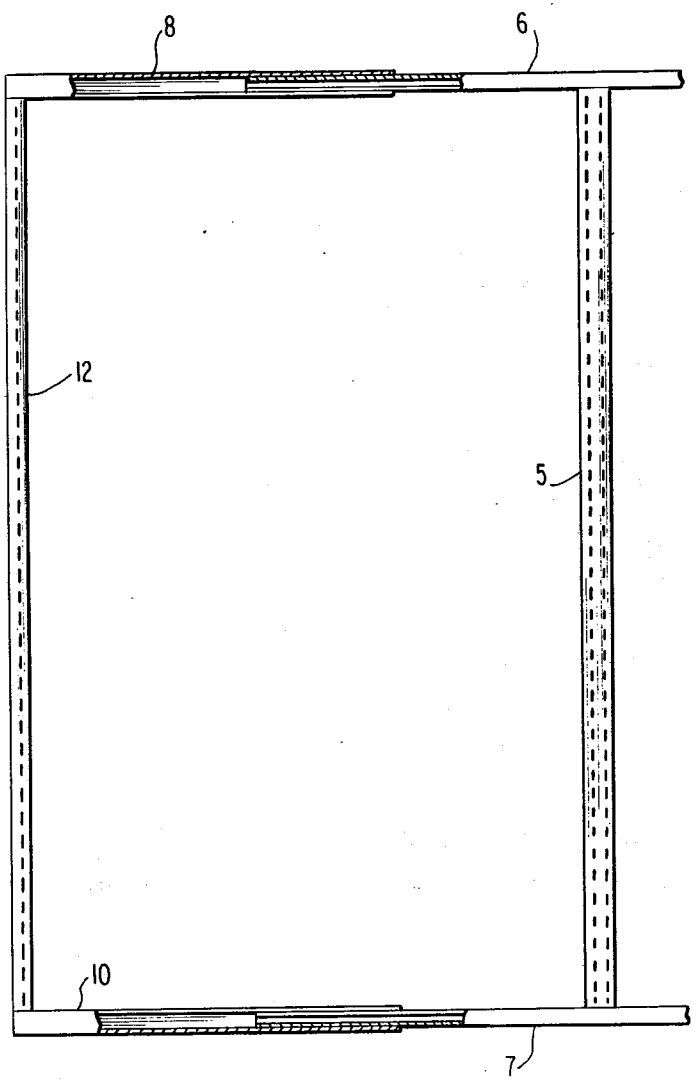
FIG. 2 is a frontal cut-away view of a structure assembly in an extended position, showing the construction of the horizontal extendible support members.

Referring to FIG. 1 of the drawings, the display rack of the present invention includes a support frame comprising a pair of end structure assemblies 1 and 2 and a pair of center structure assemblies 3 and 4. All of the structure assemblies are generally equivalent in construction except for differences in length. Consequently, only one structure assembly need be described in detail here. Structure assembly 1 includes a central, substantially vertical support member 5 whose ends are securably attached to the center of extendible upper and lower horizontal extendible support members comprising horizontal central members 6 and 7, respectively, to which horizontal extendible end members 8, 9, 10 and 11 are slidably mounted to provide for horizontal or linear adjustment. The end of each horizontal extending support member 8, 9, 10 or 11 is securably attached, e.g., by welding, to end vertical supports 12 and 13. A detailed cut-away view of structure assembly 1 showing the structure assembly in an extended position is depicted in FIG. 2. Referring again to FIG. 1, the outer pair of structure assemblies 1 and 2 are placed generally parallel to one another while the inner pair of structure assemblies 3 and 4 are placed parallel to one another, between and perpendicular to outer pairs 1 and 2. The inner or central structure assemblies 3 and 4 are placed on opposite sides of the central vertical support members 5 and 5' of the outer structure assemblies 1 and 2.

Figure 3:
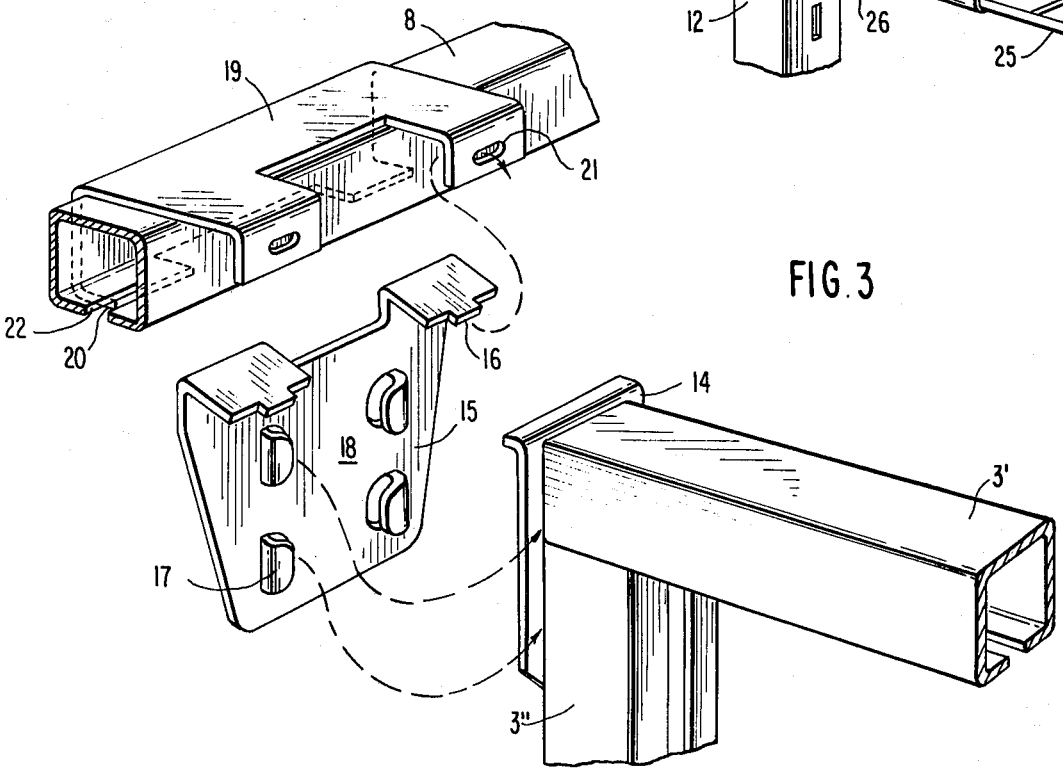
FIG. 3 is a perspective view of a preferred means for assembling the display rack of the present invention.

Each telescopic end of vertical support members 3' and 4' of the center structure assemblies 3 and 4 may be fixedly secured to the adjacent proximal ends of the horizontal extendible end members 8, 9, 10 and 11, or the horizontal central members 6 and 7 of structure assemblies 12 and 2, 1 and 2. A preferred means for fixedly securing the end structure assemblies 3 and 4 to the center structure assemblies utilizing interlocking bracket members as illustrated in FIG. 3. A tongue piece 14 is fixedly attached for example to the distal 3' of vertical support 3. A channel telescopic piece 15 having upper tabs 16 and lower punched-out tabs 17 form a channel 18 which may be attached to the tongue piece by sliding the tongue piece through the channel which engages said tongue. The channel piece 15 may be secured to a bracket piece 19 which is attached to horizontal extendible end member 8 of structure assembly 1 by means of upper tabs 16 which fit slots 21 of the bracket piece 19. A bottom lip 20 fits along the bottom surface of the horizontal extendible support member 8. A channel 22 may be formed along the bottom of support members 8, 9, 10 and 11.

Figure 4:
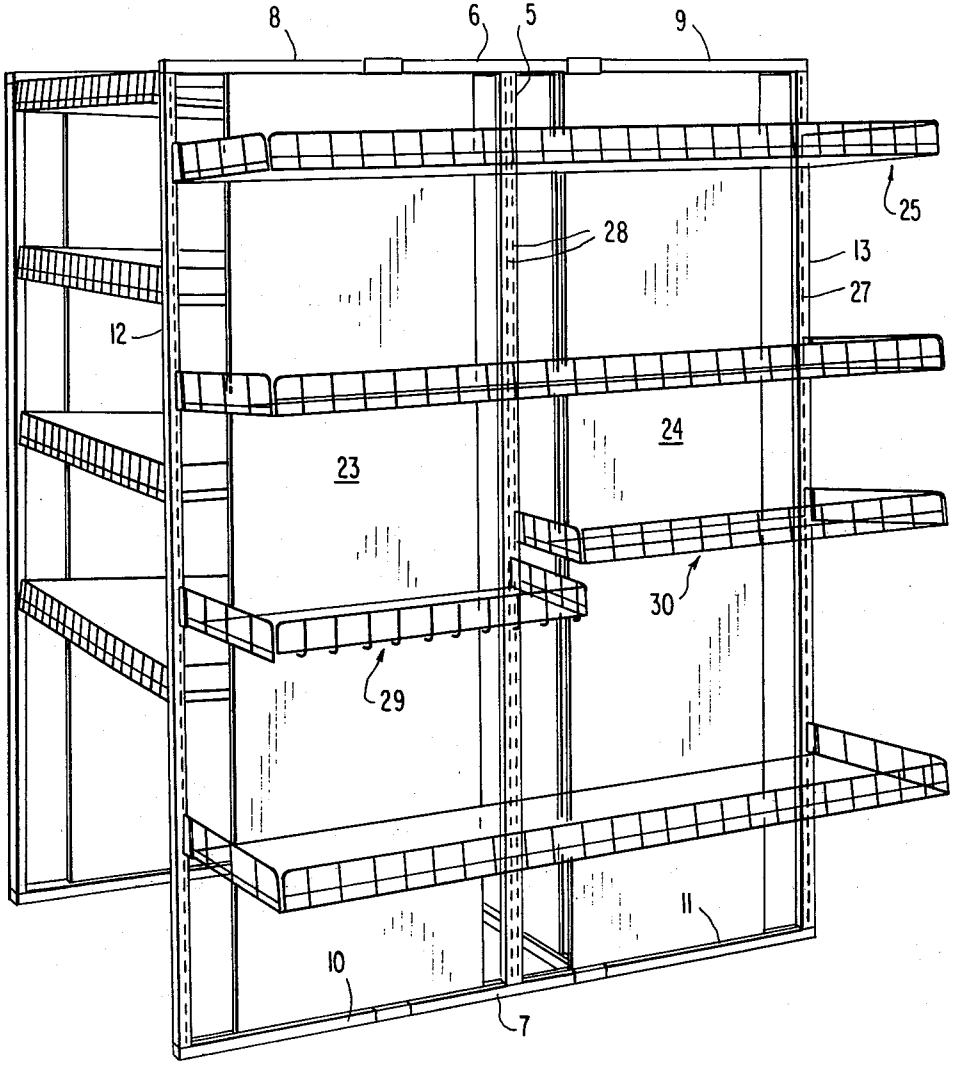
FIG. 4 is a perspective view of a preferred form of the display rack of the present invention.

Referring to FIGS. 1, 2 and 4 of the drawings, each structure assembly 1, 2, 3 and 4 may contain two slidable panels 23 and 24 located within for example the two perimeters formed by the central vertical support 5, the upper and lower horizontal support members 6 and 7, the horizontal extendible support members 8, 9, 10 and 11, and the end vertical support members 12 and 13, all of which contain a channel 22 which serves to engage and support the entire perimeter of each panel when a structure 1, 2, 3 or 4 is in the contracted position. When a structure assembly is expanded, the panels therein are engaged and supported by the upper and lower horizontal extendible support members 8 and 9 or 10 and 11.

Figure 5:
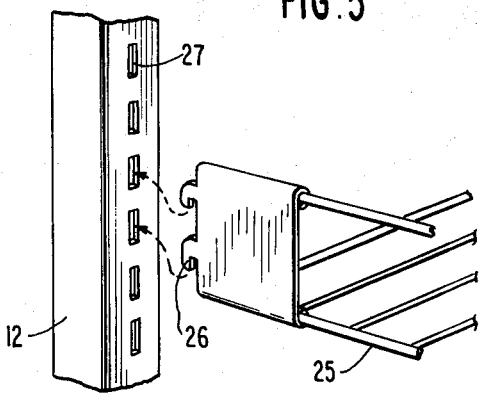
FIG. 5 is a perspective view of a preferred form of shelving, showing a method of attachment to vertical support members of the display rack of the present invention.

The assembled and positioned structure assembly support frame, see FIGS. 4 and 5, can support various types of shelves such as the wire racks 25 which are fixedly secured by means of tabs 26 attached to the back sides of the shelf which fit within the slots 27 which run the length of the end vertical support columns 12 and 13. The center vertical support members 5 may contain a double row of slots 28 which permits the securing of adjacent racks, 29 and 30, at different levels.

The present invention is preferably partially assembled prior to shipment to the retailer. Each structure assembly can be assembled in the contracted position with the center panels inserted and the tongue pieces attached to the distal ends of the end vertical supports for the center structure assemblies. Upon reaching its destination, the support frame can be easily assembled by one person who connects the interlocking brackets onto each structure assembly, expands the frame units to the desired positions and subsequently connects the interlocking members of one end frame to the interlocking members of a center frame and thereafter similarly attaches the remaining frame units. The shelves are then attached to the assembled frame.

In order to assemble an island-type display, shelves are attached to all end frame and center frame units so that shelves are attached to all four sides of the display. Where an end aisle-type display is desired, shelves can be attached to both center frames and only one end frame. For a center aisle display, shelves can be attached only to the center frames.

The preferred embodiment of the invention comprises shelves at 12" or 19" depth. In addition, 24" depth shelving may be attached to the center structure assemblies.

Although an illustrative embodiment of the invention has been described in detail herein with reference to the accompanying drawings, it is to be understood that the invention is not limited to the precise embodiments and that various changes and modifications may be effected therein without departing from the scope or spirit of the invention.

It is claimed:

1. A display rack including adjustable panels defining frames capable of supporting at least one shelf for packaged food items comprising a pair of generally parallel end structure assemblies and a pair of center structure assemblies, each having vertical and horizontal surfaces, each structure assembly further comprises centrally-positioned vertical support members, upper and lower horizontal support members positioned at the upper and lower terminus of said centrally-positioned vertical support members having horizontal telescopic end members slidably mounted thereon, and vertical support members attached to the distal ends of said horizontal telescopic support members;

said end structure assemblies being in parallel relationship to each other; said center structure assemblies also being in parallel relationship to each other and positioned between and perpendicular to said parallel end structure assemblies wherein said end vertical support members of said center structure assemblies are positioned on opposing sides of said centrally-positioned vertical support members of said parallel end structure assemblies, and each distal end of said horizontal telescopic support members of said center structure assemblies being fixedly secured to said horizontal telescopic support members of said adjacent end structure assemblies;

means for selectively mounting at least one movable shelf to the outside surfaces of said support members of said end structure assembly; and means for selectively mounting at least one movable shelf to the outside surfaces of said members of each center structure assembly.

2. A display rack according to claim 1 wherein the centrally-positioned vertical support member of said center structure assemblies are secured to said end structure assemblies by bracket means including a bracket piece, a tongue piece, and a channel piece having punched-out tabs thereon, whereby said tongue piece is attached to the distal ends of the horizontal telescopic support members of said center structure assemblies and interlockedby slidable engagement with said tabs of said channel piece attached to said bracket piece mounted on said opposing telescopic section of the horizontal support members of said end structure assemblies.

3. A display rack according to claim 1 wherein the support members have channeled means for engaging and supporting said panels within the perimeters of the structure assemblies defined by the support members.

4. A display rack according to claim 1 wherein said means for mounting said shelf on the outside surfaces of said vertical support members include perforations on said surfaces whereby at least one shelf may be selectively attached thereto by tab means extending from said shelf.

5. A display rack according to claim 1 wherein the outside surfaces of said end vertical support members each contain at least one vertical row of perforations and the outside surfaces of said central support member contain at least two vertical rows of perforations.

6. A display rack according to claim 2 wherein said horizontal telescopic support members of said center structure assemblies are secured to said horizontal support members positioned at the upper and lower terminus of said centrally-positioned vertical support members of said end structure assemblies.

* * * * *

UNITED STATES PATENT AND TRADEMARK OFFICE

CERTIFICATE OF CORRECTION

PATENT NO. : 4,444,322

DATED : April 4, 1984

INVENTOR(S) : Vernon E. Lee

It is certified that error appears in the above-identified patent and that said Letters Patent is hereby corrected as shown below:

Column 2, Line 51, delete "extendible"; (PTO error)

, Line 52, delete "extendible"; (PTO error)

Column 3, Line 1, delete "vertical" and substitute therefor --horizontal--;

, Line 6, delete "12 and 2";

, Line 7, delete "3 and 4" and substitute therefor --1 and 2--; (PTO error)

, Line 8, after "assemblies" insert --3 and 4--; (PTO error)

, Line 10, delete "distal 3'" and insert therefor --telescopic distal end 3'--; (PTO error)

, Line 11, delete "telescopic"; (PTO error)

, Line 22, after "9," insert --and top of support members--;

, Line 15, after "tongue" insert --piece--;

, Line 43, after "5" insert --, 5'--;

, Line 68, delete "at" and insert therefor --of--; (PTO error)

UNITED STATES PATENT AND TRADEMARK OFFICE

CERTIFICATE OF CORRECTION

PATENT NO. : 4,444,322

DATED : April 4, 1984

INVENTOR(S) : Vernon E. Lee

It is certified that error appears in the above-identified patent and that said Letters Patent is hereby corrected as shown below:

Column 4, Claim 1, line 19, after "horizontal" insert --telescopic-- and after "members" delete "positioned at" and substitute therefor --including horizontal central members secured to--;

, line 21, delete "having" and substitute therefor --and including--;

, line 22, delete "telescopic";

, line 23, delete "thereon" and substitute therefor --on the horizontal members-- and before "vertical" insert --end--;

, line 24, after "horizontal" delete "telescopic support" and insert therefor --end--;

, line 35, delete "telescopic support" and insert therefor --end--;

, line 37, delete "said" and substitute therefor --selected--.

UNITED STATES PATENT AND TRADEMARK OFFICE

CERTIFICATE OF CORRECTION

PATENT NO. : 4,444,322

DATED : April 4, 1984

INVENTOR(S) : Vernon E. Lee

It is certified that error appears in the above-identified patent and that said Letters Patent is hereby corrected as shown below:

Column 4, Claim 2, line 47, delete "member" and substitute therefor --members--;

, line 53, delete "telescopic support" and substitute therefor --end--;

, line 54, delete "interlockedby" and substitute therefor --interlocked by--; (PTO error)

, lines 56 and 57, delete "opposing telescopic section of the" and insert therefor --selected--;

, line 57, after "horizontal" insert --telescopic--.

Column 5, Claim 5, line 4, delete "central" and substitute therefor --centrally positioned vertical-- and delete "member" and substitute therefor --members--;

, line 5, before "contain" insert --each--.

UNITED STATES PATENT AND TRADEMARK OFFICE

CERTIFICATE OF CORRECTION

PATENT NO. : 4,444,322

DATED : April 4, 1984

INVENTOR(S) : Vernon E. Lee

It is certified that error appears in the above-identified patent and that said Letters Patent is hereby corrected as shown below:

Column 6, Claim 6, lines 2 and 3, delete "support" and substitute therefor --central--;

, line 3, delete "positioned at" and substitute therefor --secured to--.

Signed and Sealed this

Ninth Day of April 1985

[SEAL]

*Attest:*

DONALD J. QUIGG

*Attesting Officer*

*Acting Commissioner of Patents and Trademarks*